US009958236B2

(12) United States Patent
Maciuk

(10) Patent No.: US 9,958,236 B2
(45) Date of Patent: May 1, 2018

(54) ARCHERY PEEP SIGHT COVER

(71) Applicant: James Maciuk, Nolensville, TN (US)

(72) Inventor: James Maciuk, Nolensville, TN (US)

( * ) Notice: Subject to any disclaimer, the term of this patent is extended or adjusted under 35 U.S.C. 154(b) by 0 days. days.

(21) Appl. No.: 15/484,763

(22) Filed: Apr. 11, 2017

(65) Prior Publication Data

US 2017/0292811 A1 Oct. 12, 2017

Related U.S. Application Data

(60) Provisional application No. 62/320,986, filed on Apr. 11, 2016.

(51) Int. Cl.
*F41G 1/467* (2006.01)
*F41B 5/14* (2006.01)

(52) U.S. Cl.
CPC ..... *F41G 1/467* (2013.01); *F41B 5/14* (2013.01)

(58) Field of Classification Search
CPC .. F41G 1/467; F41G 11/00; F41B 5/14; F41B 5/1457
USPC ..... 124/87, 90; 150/154; 33/265
See application file for complete search history.

(56) References Cited

U.S. PATENT DOCUMENTS 947,992 A * 2/1910 Jegge ..... B68B 5/00 24/105
1,298,898 A * 4/1919 Collier ..... F16G 11/00 24/114.5
4,454,857 A * 6/1984 Miller ..... F41G 1/467 124/87
4,656,746 A * 4/1987 Gillespie ..... F41G 1/467 124/87
4,858,361 A * 8/1989 White ..... F41A 35/02 150/154
4,860,458 A * 8/1989 Ernstsen ..... F41G 1/467 124/87
5,287,842 A * 2/1994 Saunders ..... F41B 5/14 124/91
5,513,621 A * 5/1996 Vanskiver ..... F41B 5/1457 124/86
5,762,059 A * 6/1998 Strope ..... F41G 1/467 124/87
6,131,295 A * 10/2000 Cranston ..... F41G 1/467 124/87
8,047,413 B2 * 11/2011 Arajakis ..... A01M 31/006 206/315.11
8,336,533 B2 * 12/2012 Bach ..... F41B 5/14 124/87

(Continued)

*Primary Examiner* — Alexander Niconovich

(57) ABSTRACT

An archery peep sight cover envelops an archery peep sight to keep the archery peep sight clean of debris and prevents misalignment of the peep sight during transportation or storage for an archery bow. The archery peep sight cover includes a sight-cover body, a first string-attachment extrusion, a second string-attachment extrusion, and a string-receiving slit. The sight-cover body envelops the peep sight. The first string-attachment extrusion and the second string-attachment extrusion secure the archery peep sight cover to a bow string of the archery bow. The string-receiving slit receives the bowstring and the attached peep sight such that the peep sight is positioned within the sight-cover body and the bowstring frictionally engages the first string-attachment extrusion and the second string-attachment extrusion.

9 Claims, 6 Drawing Sheets

(56) References Cited

U.S. PATENT DOCUMENTS

| | | | | |
|---|---|---|---|---|
| 8,939,138 | B2 * | 1/2015 | Arajakis | F41C 23/02 124/87 |
| 2005/0284459 | A1 * | 12/2005 | Anderson | F41G 1/467 124/90 |
| 2012/0111309 | A1 * | 5/2012 | Parks | F41B 5/1457 124/88 |
| 2013/0174819 | A1 * | 7/2013 | Arajakis | F41C 23/02 124/23.1 |

* cited by examiner

ARCHERY PEEP SIGHT COVER

The current application claims a priority to the U.S. Provisional Patent application Ser. No. 62/320,986 filed on Apr. 11, 2016.

FIELD OF THE INVENTION

The present invention relates generally to an accessory device for an archery bow. More specifically, the present invention is peep sight cover to keep a peep sight of an archery bow clean during storage or transportation of the bow.

BACKGROUND OF THE INVENTION

Archery peep sights are a very popular aiming device used by archers. A peep sight, which is usually string mounted to the user's bow, allows the user to improve performance and effectiveness with their bow, allowing the archer to see through where a bowstring would be for a more accurate shot. Peep sights need to be installed correctly in order for the user to maximize the use of the peep sight. However, due to weather conditions, incidental contact, or other external factors, the peep sight can be misaligned due to these external factors.

The present invention is an archery peep sight cover. The present invention is used to protect the peep sight aperture from inclement weather, debris and incidental contact that would obscure or misalign the peep sight. The present invention attaches to a bow string for an archery bow to cover the peep sight during transportation or storage of the archery bow. The present invention is made from silicone, thermoplastic or similarly flexible materials and is available in multiple colors in preferred embodiments.

DETAIL DESCRIPTIONS OF THE INVENTION

All illustrations of the drawings are for the purpose of describing selected versions of the present invention and are not intended to limit the scope of the present invention.

The present invention is an archery peep sight cover. The present invention attaches to a string for an archery bow to cover a peep sight, in order to protect the peep sight from damage, debris obfuscation, or misalignment from unintended external interactions. The present invention is preferred to be made from silicone, thermoplastic, or similar materials to provide a durable yet flexible cover for a peep sight.

Figure 1:
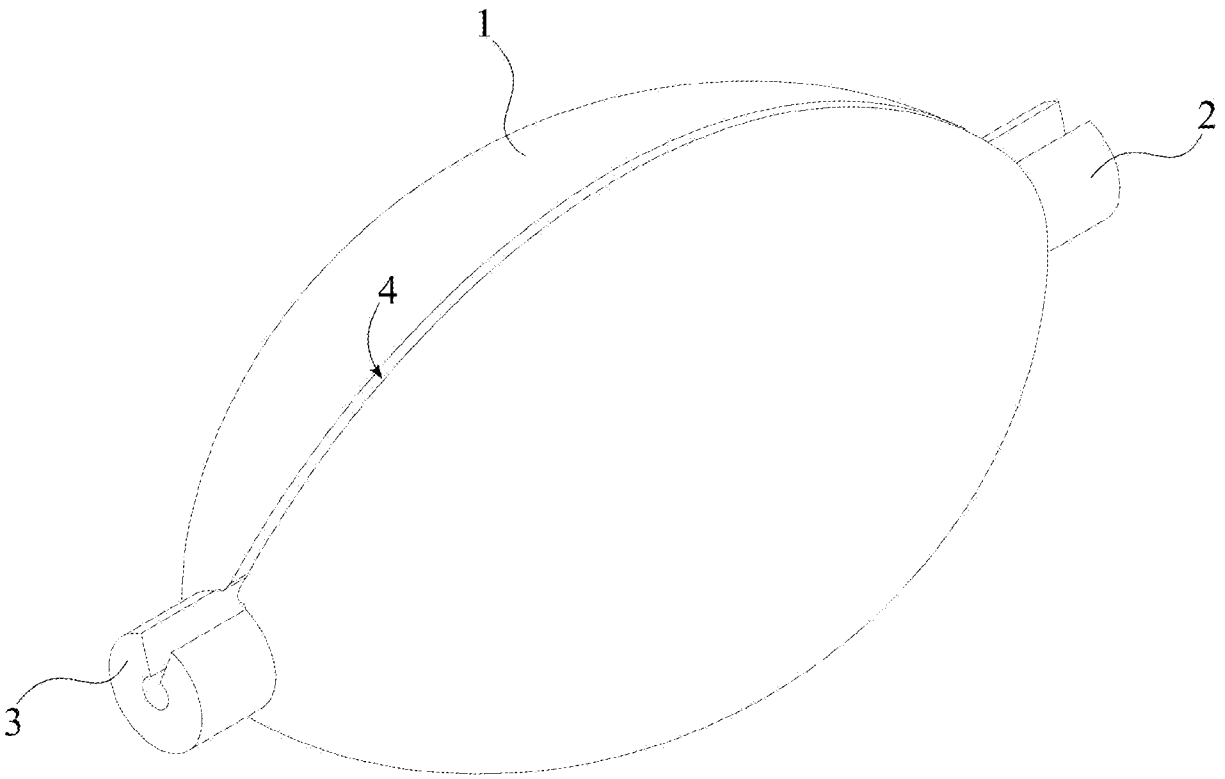
FIG. 1 is a perspective view of the present invention.
Figure 2:
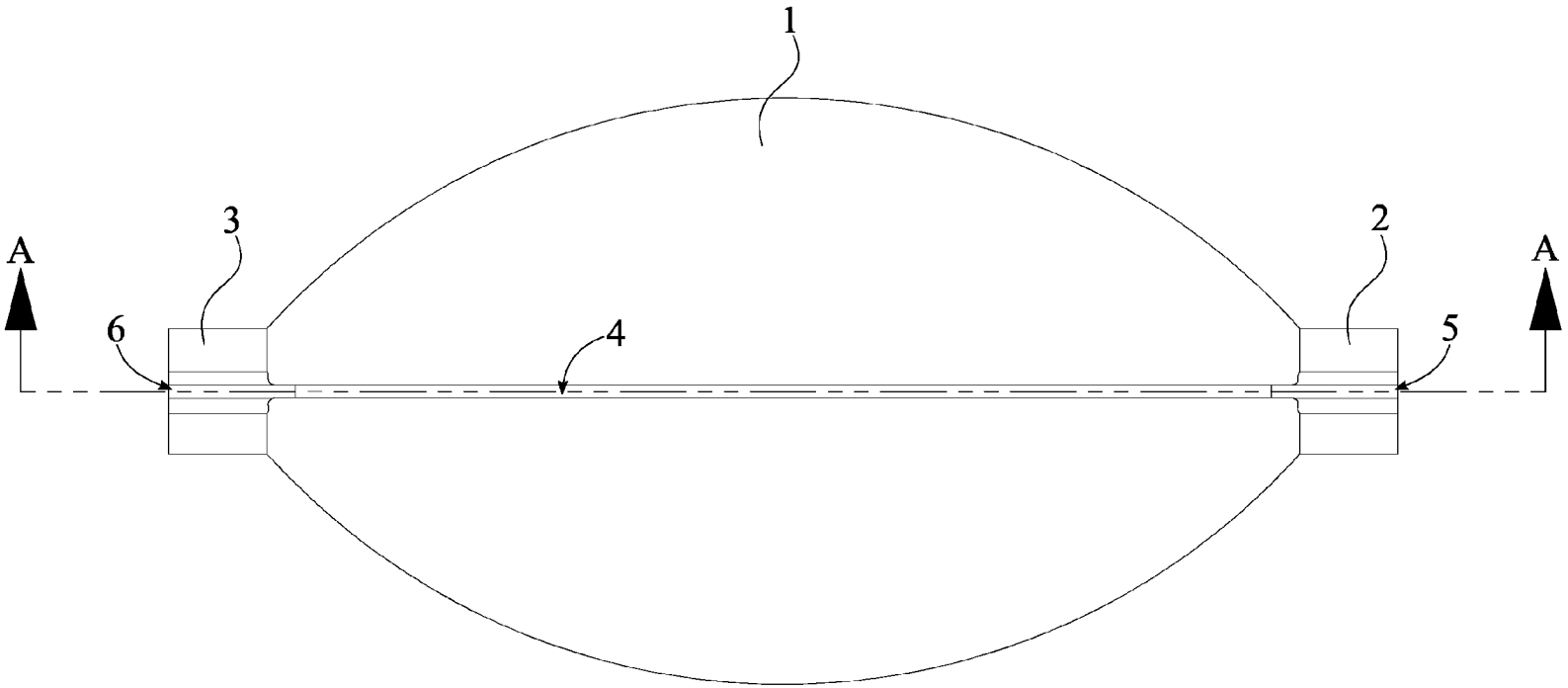
FIG. 2 is a front view of the present invention.
Figure 3:
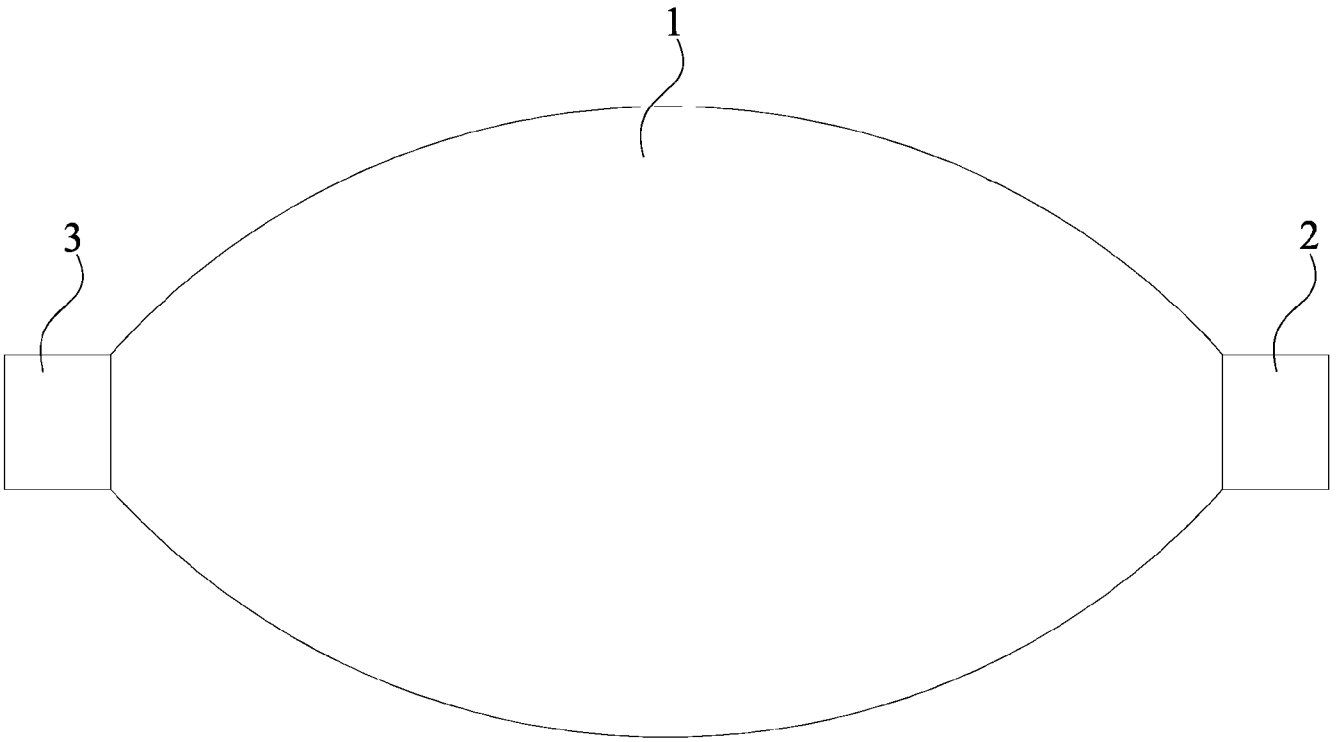
FIG. 3 is a rear view of the present invention.
Figure 6:
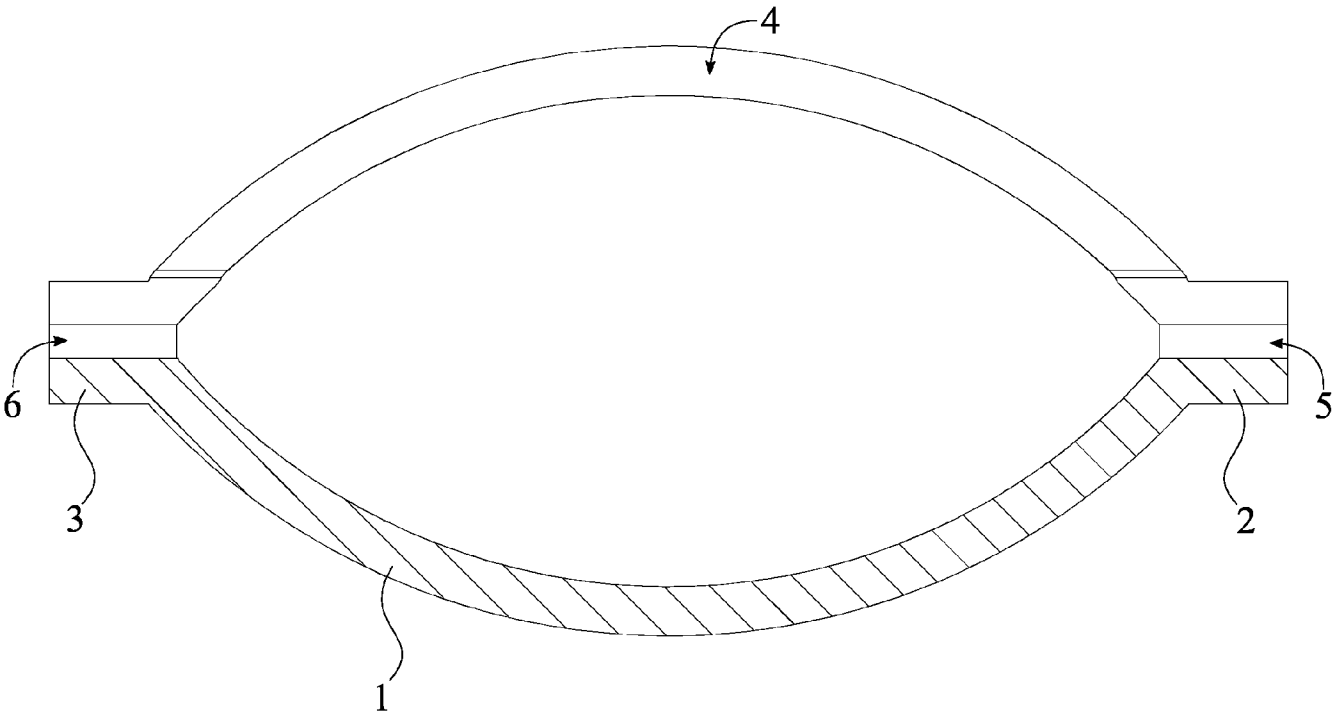
FIG. 6 is a cross-sectional view of the present invention, along the line A-A of FIG. 2.

In accordance to FIG. 1, FIG. 2, and FIG. 6, the present invention comprises a sight-cover body 1, a first string-attachment extrusion 2, a second string-attachment extrusion 3 and a string-receiving slit 4. The sight-cover body 1 envelops the peep sight on a bow string, protecting the peep sight from unintended external interference. The first string-attachment extrusion 2 and the second string-attachment extrusion 3 secure the present invention onto the bow string, allowing the present invention to be secured about the peep sight. The first string-attachment extrusion 2 is adjacently connected to the sight-cover body 1. Similarly, the second string-attachment extrusion 3 is adjacently connected to the sight-cover body 1. The first string-attachment extrusion 2 is oppositely positioned to the second string-attachment extrusion 3, about the sight-cover body 1, such that the first string-attachment extrusion 2 and second string-attachment extrusion 3, attach above and below the peep sight along the bowstring. The string-receiving slit 4 allows the present invention to engage the bow string. The string-receiving slit 4 laterally traverses through the sight-cover body 1, the first string-attachment extrusion 2, and the second string-attachment extrusion 3, in order to position the present invention along the bow string efficiently. By depressing the first string-attachment extrusion 2 and the second string-attachment extrusion 3 together, the string-receiving slit 4 separates. The separation allows the peep sight to be positioned within the sight-cover body 1, and the bowstring to be positioned within the first string-attachment extrusion 2 and the second string-attachment extrusion 3. In accordance to the preferred embodiment of the present invention, the present invention comprises a first string-retaining aperture 5 and a second string-retaining aperture 6, as shown in FIG. 2 and FIG. 4 to FIG. 6. The first string-retaining aperture 5 and the second string-retaining aperture 6 allow the bow string to be positioned within the first string-attachment extrusion 2 and second string-attachment extrusion 3, in order to secure the present invention to the bow string. The first string-retaining aperture 5 traverses through the first string-attachment extrusion 2 and the sight-cover body 1. Similarly, the second string-retaining aperture 6 traverses through the second string-attachment extrusion 3 and the sight-cover body 1. The first string-retaining aperture 5 is collinear to the second string-retaining aperture 6, such that the present invention does not contort the bow string. In accordance to FIG. 4 the string-receiving slit 4 traverses into the first string-retaining aperture 5 to allow the bow string to be positioned within the first string-retaining aperture 5. Similarly, the string-receiving slit 4 traverses into the second string-retaining aperture 6 to allow the bow string to be positioned within the second string-retaining aperture 6, shown in FIG. 5. The bow string is frictionally engaged with the first string-attachment extrusion 2 and the second string-attachment extrusion 3 through the first string-retaining aperture 5 and the second string-retaining aperture 6 respectively.

Figure 4:
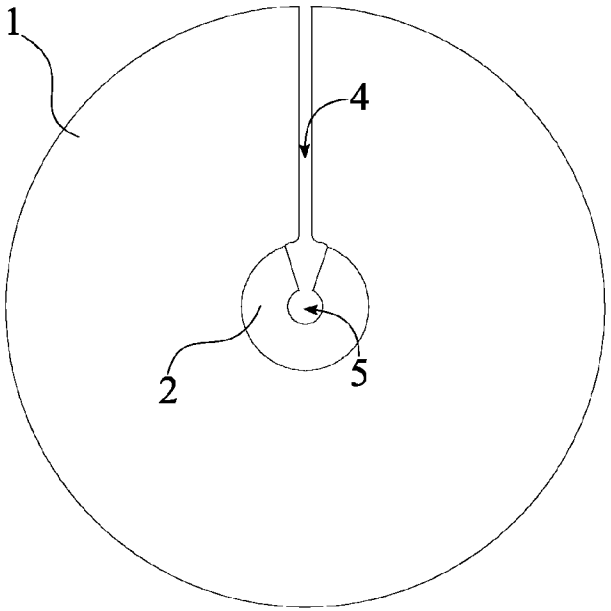
FIG. 4 is a top view of the present invention.
Figure 5:
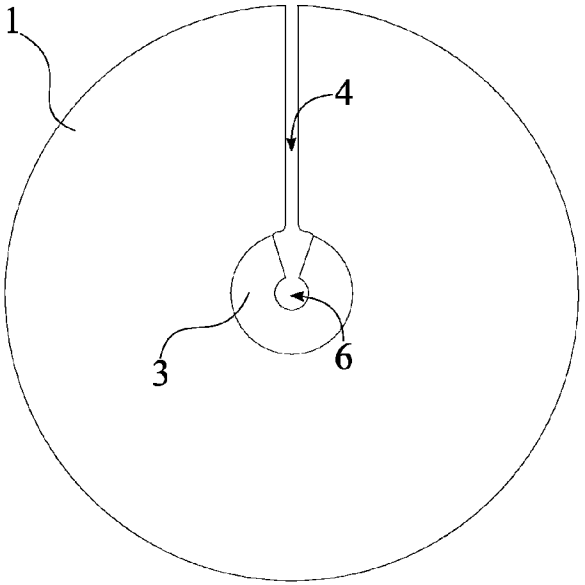
FIG. 5 is a bottom view of the present invention.

Further in accordance to the preferred embodiment, the first string-retaining aperture 5 is oriented normal to the first string-attachment extrusion 2, detailed in FIG. 4. Similarly, the second string-retaining aperture 6 is oriented normal to the second string-attachment extrusion 3, shown in FIG. 5. This configuration prevents the present invention from contorting the bow string and prevents stress to the present invention.

The sight-cover body 1 is flexible, as the present invention is preferred to be made from silicon, thermoplastic, or similar materials. As the user compresses the first string-attachment extrusion 2 towards the second string-attachment extrusion 3, the sight-cover body 1 deforms to enlarge the string-receiving slit 4. With the string-receiving slit 4 enlarged, the user is able to place the sight-cover body 1 over the peep sight. The user engages the bow string with the first string-attachment extrusion 2 and the second string-attachment extrusion 3. The user positions the peep sight between the first string-attachment extrusion 2 and the second string-attachment extrusion 3 and positions the bow sting within the first string-retaining aperture 5 and second string-retaining aperture 6. When the user then releases the present invention, the string-receiving slit 4 contracts, the first string-attachment extrusion 2 and the second string-attachment extrusion 3 extend away from each other, and the bow string is secured within the first string-attachment extrusion 2 and the second string-attachment extrusion 3.

Although the invention has been explained in relation to its preferred embodiment, it is to be understood that many other possible modifications and variations can be made without departing from the spirit and scope of the invention as hereinafter claimed.

What is claimed is:

1. An archery peep sight cover comprising:

a sight-cover body;

a first string-attachment extrusion;

a second string-attachment extrusion;

a first string-receiving slit;

a second string-receiving slit;

a third string-receiving slit;

a first string-retaining aperture;

a second string-retaining aperture;

the first string-attachment extrusion being adjacently connected to the sight-cover body;

the second string-attachment extrusion being adjacently connected to the sight-cover body;

the first string-attachment extrusion and the second string-attachment extrusion being oppositely positioned to each other along the sight-cover body;

the sight-cover body comprising an ellipsoid solid wall and an ellipsoid internal chamber;

the ellipsoid internal chamber being formed by the ellipsoid solid wall;

the first string-attachment extrusion normally penetrating the ellipsoid solid wall of the sight-cover body;

the second string-attachment extrusion normally penetrating the ellipsoid solid wall of the sight-cover body;

the first string-attachment extrusion and the second string-attachment extrusion being oppositely positioned to each other along the ellipsoid solid wall of the sight-cover body;

the first string-receiving slit laterally partially traversing through the ellipsoid solid wall of the sight-cover body, the ellipsoid solid wall of the sight-cover body being traversed through by the first string-receiving slit without being traversed through by any additional through holes;

the first string-receiving slit being communicated with the ellipsoid internal chamber;

the second string-receiving slit laterally traversing through the first string-attachment extrusion;

the second string-receiving slit being communicated with the ellipsoid internal chamber;

the third string-receiving slit laterally traversing through the second string-attachment extrusion;

the third string-receiving slit being communicated with the ellipsoid internal chamber;

the first string-retaining aperture normally traversing through the first string-attachment extrusion;

the first string-retaining aperture being communicated with the ellipsoid internal chamber and the second string-receiving slit;

the second string-retaining aperture normally traversing through the second string-attachment extrusion;

the second string-retaining aperture being communicated with the ellipsoid internal chamber and the third string-receiving slit;

the second string-receiving slit being laterally tapered towards the first string-retaining aperture; and the third string-receiving slit being laterally tapered towards the second string-retaining aperture.

2. The archery peep sight cover as claimed in claim 1 comprising:

the first string-retaining aperture and the second string-retaining aperture being collinear to each other.

3. The archery peep sight cover as claimed in claim 1 comprising:

the second string-receiving slit and the third string-receiving slit being collinear to each other.

4. The archery peep sight cover as claimed in claim 1 comprising:

the sight-cover body being flexible.

5. The archery peep sight cover, as claimed in claim 4 comprising:

the sight-cover body being made from a silicone material or a thermoplastic material.

6. The archery peep sight cover as claimed in claim 1 comprising:

the first string-attachment extrusion being flexible.

7. The archery peep sight cover as claimed in claim 6 comprising:

the first string-attachment extrusion being made from a silicone material or a thermoplastic material.

8. The archery peep sight cover as claimed in claim 1 comprising:

the second string-attachment extrusion being flexible.

9. The archery peep sight cover as claimed in claim 8 comprising:

the second string-attachment extrusion being made from a silicone material or a thermoplastic material.

* * * * *